US011827048B2

(12) United States Patent
Roudaut

(10) Patent No.: US 11,827,048 B2
(45) Date of Patent: Nov. 28, 2023

(54) MARKER FOR VARIABLE SHADING UNDER PRESSURE

(71) Applicant: SOCIÉTÉ BIC, Clichy (FR)

(72) Inventor: Etienne Roudaut, Clichy (FR)

(73) Assignee: SOCIÉTÉ BIC, Clichy (FR)

( * ) Notice: Subject to any disclaimer, the term of this patent is extended or adjusted under 35 U.S.C. 154(b) by 97 days.

(21) Appl. No.: 17/619,288

(22) PCT Filed: Jul. 2, 2020

(86) PCT No.: PCT/EP2020/068603

§ 371 (c)(1),
(2) Date: Dec. 15, 2021

(87) PCT Pub. No.: WO2021/001463

PCT Pub. Date: Jan. 7, 2021

(65) Prior Publication Data

US 2022/0297466 A1 Sep. 22, 2022

(30) Foreign Application Priority Data

Jul. 4, 2019 (EP) ..... 19184496

(51) Int. Cl.
*B43K 1/12* (2006.01)
*B43K 8/08* (2006.01)
*B43K 5/18* (2006.01)

(52) U.S. Cl.
CPC ..... *B43K 1/12* (2013.01); *B43K 5/1845* (2013.01); *B43K 8/08* (2013.01)

(58) Field of Classification Search
CPC . B43K 1/006; B43K 1/12; B43K 8/08; B65D 47/42
USPC ..... 401/198, 199, 205, 206
See application file for complete search history.

(56) References Cited

U.S. PATENT DOCUMENTS 3,393,963 A * 7/1968 Nadai ..... B65D 47/42 401/207
4,017,871 A 4/1977 Hubbard
4,076,428 A 2/1978 Otake et al.
4,568,214 A * 2/1986 Abe ..... A46B 11/0041 401/199
4,610,556 A 9/1986 Tsai
4,671,692 A 6/1987 Inaba
5,290,116 A 3/1994 Chang
5,480,250 A 1/1996 Birden
5,551,789 A 9/1996 Okawa et al.
(Continued)

FOREIGN PATENT DOCUMENTS

CN 104070884 B 8/2018

OTHER PUBLICATIONS

International Search Report and Written Opinion issued in International Application PCT/EP2020/068603, dated Aug. 12, 2020 (14 pages).

*Primary Examiner* — David P Angwin
*Assistant Examiner* — Bradley S Oliver
(74) *Attorney, Agent, or Firm* — Bookoff McAndrews, PLLC

(57) ABSTRACT

A marker nib for applying ink to a surface may comprise an applicator having a writing tip configured to contact the surface to apply ink thereto, and a transporter configured to transport ink received from a reservoir to the applicator, the applicator being configured to increase its ink flow rate at the writing tip when pressure is applied thereto.

19 Claims, 3 Drawing Sheets

(56) References Cited

U.S. PATENT DOCUMENTS

| | | | |
|---|---|---|---|
| 5,651,627 | A | 7/1997 | Dowzall et al. |
| 5,967,687 | A | 10/1999 | Pike |
| 6,117,260 | A | 9/2000 | Rossi |
| 6,572,297 | B2 | 6/2003 | Korper |
| 6,729,788 | B2 | 5/2004 | Bouveresse |
| 7,172,360 | B2 | 2/2007 | McSweeney et al. |
| 7,467,907 | B2 | 12/2008 | Gaynes et al. |
| 7,481,593 | B2 | 1/2009 | Kwan et al. |
| 8,393,816 | B1 | 3/2013 | Schumacher |
| 8,753,027 | B2 | 6/2014 | Ballot |
| 2018/0199691 | A1 | 7/2018 | Takahashi |
| 2019/0084340 | A1 | 3/2019 | Chen |

* cited by examiner

[Fig. 1]
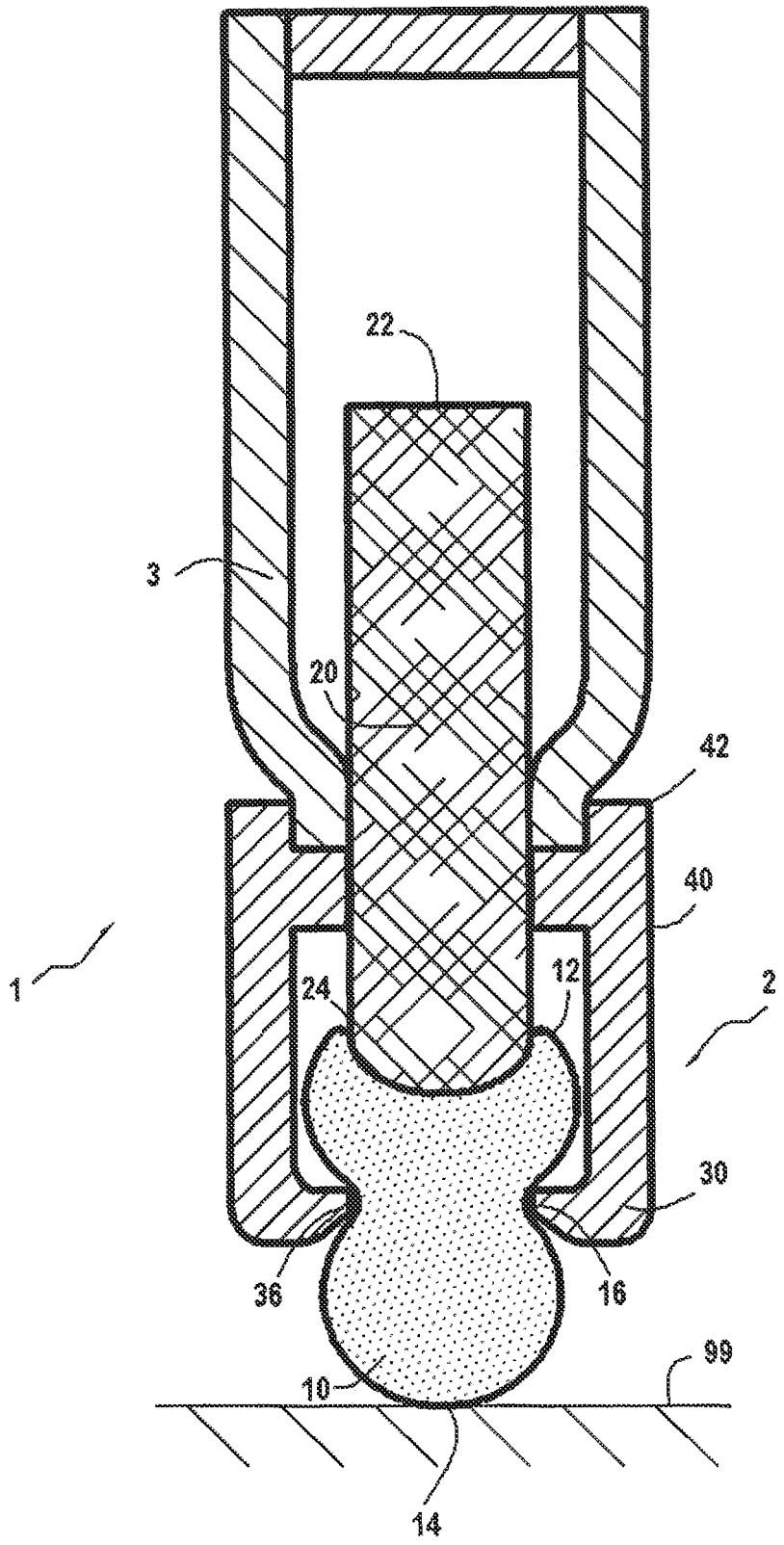

[Fig. 2]
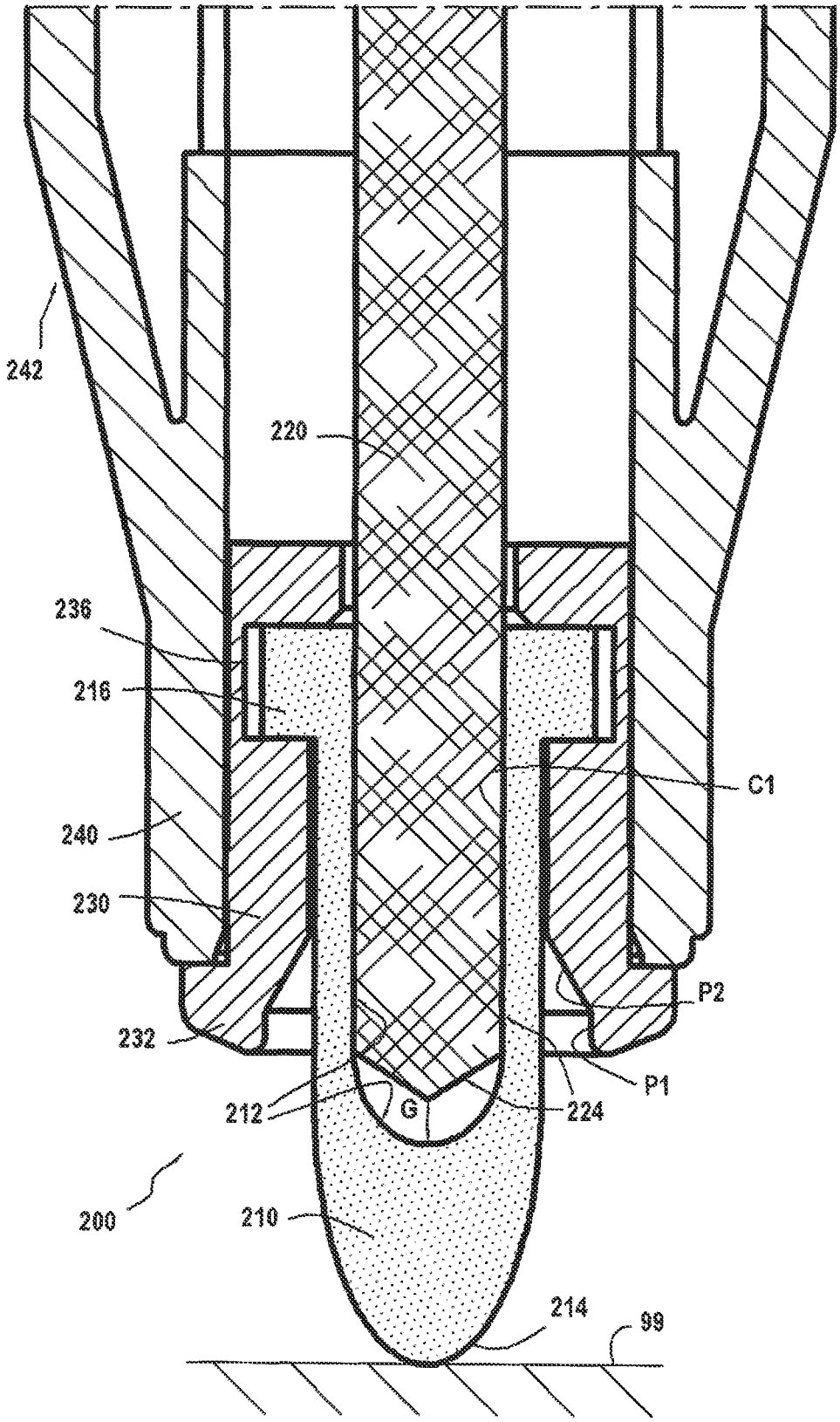

[Fig. 3]
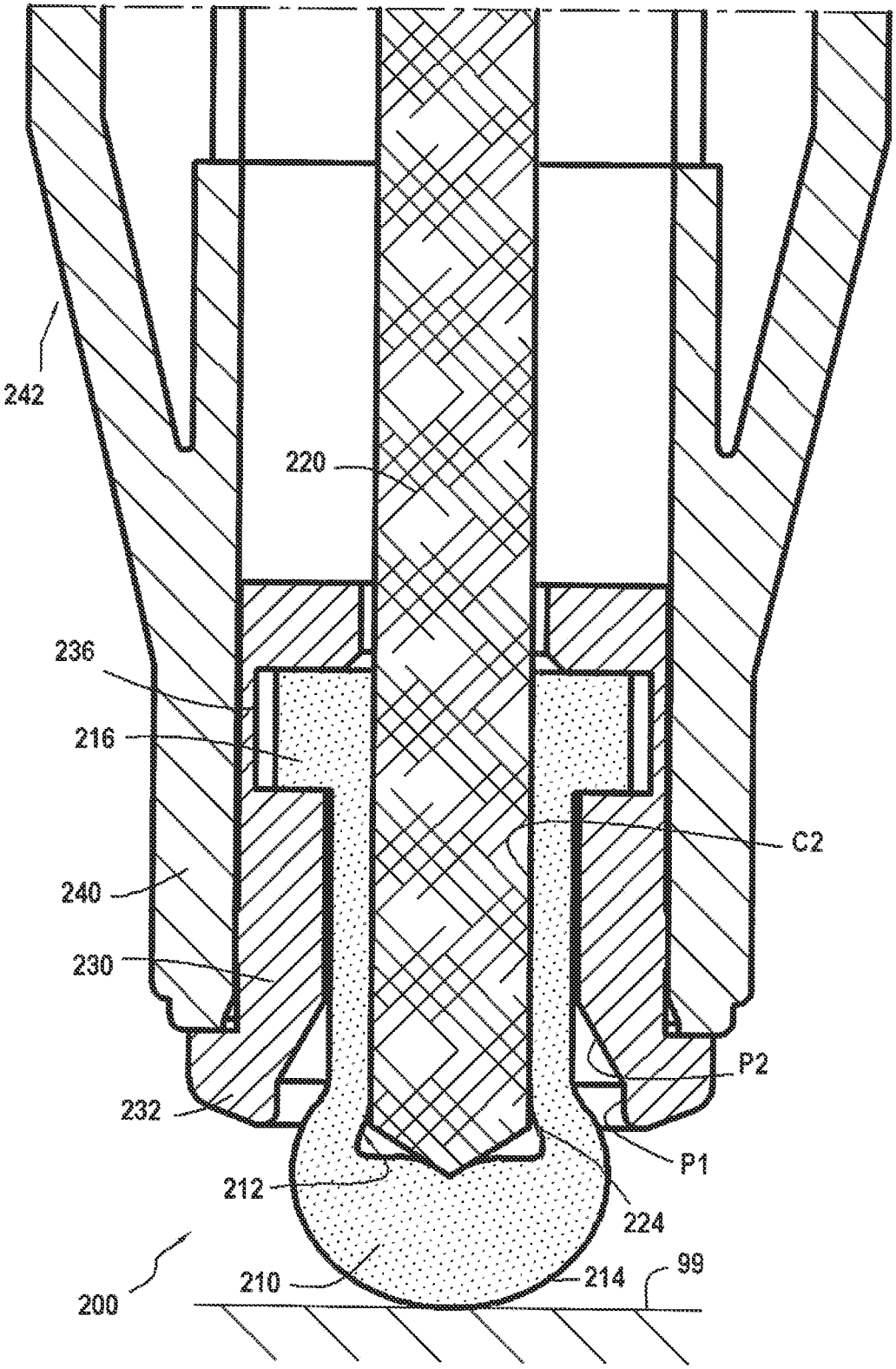

MARKER FOR VARIABLE SHADING UNDER PRESSURE

CROSS REFERENCE TO RELATED APPLICATIONS

This application is a National Stage Application of International Application No. PCT/EP2020/068603, filed on Jul. 2, 2020, now published as WO 2021/001463 A1 and which claims priority from EP19184496.8, filed on Jul. 4, 2019, the entire contents of which are incorporated herein by reference.

FIELD

The present disclosure relates to the field of markers. For the purposes of the present disclosure, a "marker" it is understood to mean any kind of marker such as marker pens, fineliners, marking pens, felt-tip markers, felt-tip pens, sketch pins, koki, magic markers, spidol, sign pens, name pens, felt pens, felts, etc.

BACKGROUND ART

Typically, writing or drawing with a marker does not allow for control of marking intensity during a given stroke, as is possible with a pencil, for example. In other words, with a typical marker no modulation marking intensity is possible within a given stroke. Therefore, there is a need for a marker wherein variable stroke intensity is possible.

SUMMARY

According to examples, a marker nib may be provided for applying ink to a surface, comprising an applicator having a writing tip configured to contact the surface to apply ink thereto, and a transporter configured to transport ink received from a reservoir to the applicator. The applicator is configured to increase its ink flow rate at the writing tip when pressure is applied thereto.

According to examples, the applicator may be reversibly deformable in compression from a first state to a second state. The applicator may present a first flow rate in the first state and a second flow rate in the second state.

According to examples, the applicator may be configured to remain in the first state when a pressure applied to the applicator by the surface is less than or equal to a first value. The applicator may additionally or alternatively be configured to enter the second state when the pressure applied to the applicator by the surface is greater than or equal to a second value, greater than the first value.

According to examples, the applicator may be in contact with the transporter over a first contact area in the first state. The applicator may be in contact with the transporter over a second contact area in the second state. The second contact area may be greater than the first contact area.

According to examples, the marker nib extend along an axial direction, and the first contact area may have a length of 3 mm or more as measured along the axial direction in the first state.

According to examples, the applicator may comprise a first material and the transporter may comprise a second material, and the first material may have a higher capillarity than the second material.

According to examples, the applicator may comprise a first material and the transporter may comprise a second material, and the first material may be softer than the second material.

According to examples, the applicator may comprise a first material and the transporter may comprise a second material, and the first material lay comprise a foam. Additionally or alternatively, the second material may comprise one or more of the following: natural felt, synthetic felt, sintered plastic.

According to examples, the marker nib may extend along an axial direction, and may comprise an applicator mount to which the applicator is mounted. The applicator mount may comprise a peripheral wall configured to authorize and limit a deformation of the applicator when pressure is applied thereto.

According to examples, the marker nib may comprise an applicator mount, to which the applicator is mounted. The marker nib may comprise a transporter mount, to which the transporter is mounted. The transporter mount may be connected to the applicator mount. The transporter mount may be connectable to the reservoir.

According to examples, the marker nib may extend along an axial direction and may comprise a gap arranged between the transporter and the applicator along the axial direction.

According to examples, the gap may have a length of 5 mm or less, as measured along the axial direction, when no pressure is applied to the writing tip by the surface.

According to examples, the gap may be at filled at least in part when a pressure is applied to the applicator.

According to examples, a marker may be provided. The marker may comprise a marker nib and an ink reservoir connected to the transporter.

According to examples, the reservoir may comprise a free ink tank and/or an ink storage medium.

The disclosed marker and nib may allow a user to vary marking intensity by modulating pressure applied to the surface by the applicator or vice versa. In particular, this means that the disclosed marker and nib allows the user to obtain at least two different marking intensities, depending on the pressure applied.

BRIEF DESCRIPTION OF THE DRAWINGS

The disclosure may be more completely understood in consideration of the following detailed description of aspects of the disclosure in connection with the accompanying drawings, in which:

FIG. 1 represents a marker.

FIG. 2 represents a detailed view of a marker nib in a first state.

FIG. 3 represents the marker nib of FIG. 2 in a second state.

While aspects of the disclosure are amenable to various modifications and alternative forms, specifics thereof have been shown by way of example in the drawings and will be described in detail. It should be understood, however, that the intention is not to limit aspects of the disclosure to the particular embodiment(s) described. On the contrary, the intention of this disclosure is to cover all modifications, equivalents, and alternatives falling within the scope of the disclosure.

DETAILED DESCRIPTION

As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

The following detailed description should be read with reference to the drawings. The detailed description and the drawings, which are not necessarily to scale, depict illustrative aspects and are not intended to limit the scope of the disclosure. The illustrative aspects depicted are intended only as exemplary.

FIG. 1 shows a partially-sectional view of an exemplary marker 1 according to the present disclosure during use to mark a surface 99.

The marker 1 may include a marker nib 2 and an ink reservoir 3 connectable to the marker nib. Ink from the reservoir 3 may be applied to the surface 99 by means of the marker nib 2.

The reservoir 3 may include a free ink tank and/or an ink storage medium. As a non-limiting example, the ink-storage medium may be fibrous and/or porous.

The marker nib 2 may include an applicator 10 having a writing tip configured to contact the surface so as to apply ink thereto, and a transporter 20 for supplying ink from the reservoir 3 to the applicator 10. The applicator 10 may be configured to increase its ink flow rate at the writing tip from a first flow rate to a second flow rate when pressure is applied thereto by the surface 99. As a non-limiting example, the ink may one or more of the following: water-based, alcohol-based, fluorescent, permanent.

The transporter 20 may be configured to transport ink from the reservoir 3 to the applicator. Additionally or alternatively, the transporter 20 may be configured to receive ink from the reservoir 3 that has been deposited at some intermediate location between the reservoir 3 and the applicator 10.

Ink may enter the transporter 20 by way of an intake face 22 of the transporter 20. The intake face 22 may be provided to communicate with the reservoir 3. For example, the intake face 22 may be at least partially arranged inside the reservoir 3 when the marker nib 2 is connected to the reservoir 3.

When the transporter 20 is configured to receive ink deposited at an intermediate location, the intake face 20 may at be additionally or alternatively be arranged at least partially outside of the reservoir 3.

The transporter 20 may comprise a discharge face 24 for sending ink to the applicator 10. The discharge face 24 of the transporter 20 and the intake face 22 of the transporter 20 may be connected to one another so as to be in fluid communication with each other via a material of the transporter 20. According to examples of the present disclosure, this material may include one or more of the following: natural felt, synthetic felt, sintered plastic. As such as at least one of these may allow the transporter 20 to convey received ink towards the applicator 10 through capillary action. As a non-limiting example, the synthetic felt may a fibrous component including one or more of the following materials: nylon, acrylic, polyester. As a non-limiting example, the sintered plastic may include polyethylene and/or polypropylene.

The applicator 10 includes an intake face 12 for receiving ink from the transporter 20 and an application face 14 arranged on the writing tip for discharging ink onto the surface 99. The intake face 12 of the applicator 10 and the application face 14 of the applicator 10 may be connected to one another so as to be in fluid communication with each other via a material of the applicator 10. According to examples of the present disclosure, this material may include a foam. The foam may allow for ink to be retained in the applicator 10 until pressure is applied thereto. The foam may be open-celled and/or ink-permeable, for example. As a non-limiting example, the foam may include or be based on polyethylene and/or polyurethane.

The applicator 10 may be reversibly deformable from a first state to a second state, and may present the first flow rate in the first state, and the second flow rate in the second state. Thus, a user may be able to increase or decrease the flow rate by increasing or decreasing the amount of deformation created by pressure applied to the applicator 10 from the surface 99.

As a non-limiting example, deformation may occur along a deformation path. The deformation path may be predetermined. For example, the deformation path may be predetermined to extend from the writing tip (or application surface 14 thereof) of the applicator 10 towards the transporter 20 (or discharge surface 12 thereof), or even towards the reservoir 3 (or connection therefor). In this regard, the deformation path may be considered to extend along an axial direction of the marker nib 2 or even an axial direction of the marker 1.

In the first state, the applicator 10 may be able to apply ink to the surface 99 at a first flow rate. This first flow rate may, for example be governed in large part by phenomena such as capillary action between the surface 99 and the applicator 10, and/or between capillary action between the applicator 10 and the transporter 20.

As an example, the material of the applicator 10 may have a greater capillarity than the material of the transporter 20. One material may be understood to have a greater capillarity than another if the one material exhibits a stronger and/or more pronounced capillary action than the other material. Thus capillary action may be more pronounced in the applicator 10 than in the transporter 20, thus causing ink to be drawn into the applicator 10 from the transporter 20.

As the applicator 10 is deformed towards the second state, the applicator 10 may be able to apply ink to the surface at a second flow rate. The second flow rate may be greater than the first flow rate because, in addition to discharge of ink through capillary action, ink may be forced out of the material of the applicator 10 as the applicator is deformed.

In addition to, or as an alternative to the capillarity relationship described above, as an example, the material of the applicator 10 may be softer than the material of the transporter 20. Thus, the applicator 10 may be deformed more readily than the transporter 20 when pressure is applied to the applicator 10 by the surface 99. As non-limiting examples, the material of the transporter 20 may have a hardness of 20 shore A durometer or less, or of 20 to 40 shore A durometer, of 40 shore A durometer or more. Additionally or alternatively, as non-limiting examples, the material of the applicator 10 may have a hardness of 20 shore A durometer or less, or of 20 to 40 shore A durometer, or of 40 shore A durometer or more.

As a non-limiting example, the applicator 10 may be reversibly deformable in compression from the first state to the second state.

The applicator 10 may be configured to remain in the first state when a pressure applied to the applicator 10 by the surface 99 is less than or equal to a first value, in particular which allows a first constant marking intensity. Thus, a user may be able provide a relatively constant marking intensity at relatively low pressures. The first value may, for example, correspond to a force of approximately 100 mN applied normal to the surface 99 and/or applied along the longitudinal direction of the marker 1 (or marker nib 2 thereof).

The applicator 10 may be configured to enter the second state when the pressure applied to the applicator 10 by the surface 99 is greater than or equal to a second value, greater than the first value, in particular which allows a second marking intensity, greater than the first marking intensity. For example, the second value may correspond to a force of approximately 300 mN applied normal to the surface 99 and/or applied along the longitudinal direction of the marker 1 (or marker nib 2 thereof). Thus, even relatively weak or uncoordinated users such as children may be able to place the applicator in the second state.

Offering a relatively large difference between the first and second values may improve the ability to produce flow rates intermediate to the first and second flow rates.

The marker nib 2 may comprise an applicator mount 30, to which the applicator 10 is mounted. As a non-limiting example, the applicator 10 may comprise a groove 16 for receiving a retaining ridge 36 borne on the applicator mount 30. The retaining ridge 36 and the groove 16 may be dimensioned such that the material of the applicator 10 is at least locally compressed by the applicator mount 30 so as to stabilize the applicator 10. For example the compression force applied to the groove 16 by the retaining ridge 36 may be greater than the force applied to the applicator 10 in order to place the applicator 10 in the second state.

The marker nib 2 may comprise a transporter mount 40, to which the transporter 20 is mounted such that the intake face 12 of the applicator 10 is arranged to face the discharge face 24 of the transporter. The transporter mount 40 may be connected to the applicator mount 30 or even be a part of the applicator mount 30.

The applicator mount 30 may allow the applicator 10 to be maintained in contact with the transporter 20 so as to preserve ink transmissibility from the transporter 20 to the applicator 10 as the applicator 10 is deformed from the first state to the second state or vice versa. For example, the applicator 10 may be held in contact with the transporter 20 as the applicator 10 is compressed or decompressed.

The marker nib 2 may comprise a connection portion 42 for connecting the transporter mount 40 to the reservoir 3 so that ink supplied by the reservoir 3 is receivable by the intake face 22 of the transporter 20. As a non-limiting example, the connection portion may allow the nib to be connected to the reservoir by one or more of the following techniques: press-fitting, snap-fitting, welding (ultrasonically or otherwise), adhering/bonding, molding (such as single-shot, multiple-shot, overmolding, for example, or otherwise). The intake face 22 of the transporter 20 may be plunged into the reservoir 3, for example.

For example, the material of the applicator 10 may be resilient, so as to allow the applicator 10 to leave the second state when pressure is removed from the applicator 10. Thus, the a user may allow the applicator 10 to return to the first state from the second state by reducing pressure applied to the applicator 10 by the surface 99.

FIGS. 2-3 shows an exemplary marker nib 200 according to the present disclosure. The foregoing disclosure of the marker nib 2 represented in FIG. 1 is also generally applicable to the marker nib 200 represented in FIGS. 2-3. For simplicity of representation, FIGS. 2-3 do not represent the intake face of transporter 220 or a reservoir to which the marker nib 200 may be connected via connection portion 242 of the transporter mount 240. As a non-limiting example, applicator 210 may be retained within applicator mount 230 by means of a retaining groove 236 borne on applicator mount 230 cooperating with a flange 216 borne on applicator 210. The flange 216 and the retaining groove 236 may be dimensioned such that the material of the applicator 210 is at least locally compressed by the applicator mount 230 so as to stabilize the applicator 210. For example the compression force applied to the flange 216 by the retaining groove 236 may be greater than the force applied to the applicator 210 in order to place the applicator 210 in the second state.

As seen in FIG. 2, transporter 220 and applicator 210 may be inserted into one another, so that a peripheral portion of the intake face 212 of the applicator 210 is in contact with a peripheral portion of the discharge face 224 of the transporter 220 when the applicator 210 is in the first state.

In a vicinity of the application face 214 of the applicator 210, the applicator mount 230 may include a collar 232 that includes a peripheral wall portion P1 which is offset from the surface of the applicator 210 in a direction perpendicular to the axial direction. This peripheral wall portion P1 may help to stabilize the writing tip of the applicator 210 as the applicator 210 undergoes deformation by limiting or reducing deflection of the writing tip with respect to the axial direction.

Further from the application face 214 of the applicator 210 than the collar 232 (as measured in the axial direction), the applicator mount 230 may include a peripheral wall portion P2 which contacts the applicator 210. This peripheral wall portion P2 may help to oppose bending movements of the applicator 210 and/or the transporter 220.

The thickness of the applicator 210, as measured normal to the axial portion of the intake face 212 of the applicator 210, may be greater than the thickness of the applicator 210, as measured normal to the peripheral portion of the intake face 212 of the applicator. This increased thickness may stabilize the application face 214 against the surface during application of ink thereto.

When the applicator 210 is in first state, it may be in contact with the transporter 220 over a first contact area C1. Ink may be transferred to the applicator 210 from the transporter 220 over this area. As a non-limiting example the first contact area C1 may have a length of 1 mm or less, or of 1-3 mm, or of 3-10 mm, or of 10 mm or more as measured along the deformation path. As a non-limiting example, the first contact area C1 may represent up to 10% or more of a cross-sectional area of the applicator 210 as measured perpendicular to the longitudinal direction of the marker (or marker nib thereof). As a non-limiting example, the cross-sectional area may be measured tangent or parallel to an axial portion of the intake face 212 when the applicator 210 is in the first state.

A gap "G" may be provided between the transporter 220 and the applicator 210 when the applicator 210 is in the first state. This gap "G" may be arranged along the deformation path of the marker nib 200. The gap "G" may provide a region where deformation of the applicator 210 is encouraged. For example, the gap "G" may be provided between an axial portion of the intake face 212 of the applicator 210 and an axial portion of the discharge face 224 of the transporter 220.

As a non-limiting example, the gap "G" may have a length of 5 mm or less, as measured along the deformation path, when the applicator 210 is in the first state, or when no pressure is applied to the writing tip by the surface 99. As a non-limiting example, the applicator 210 may even be in the first state when no pressure is applied to the writing tip by the surface 99. A gap length of 5 mm may allow an applicator 210 of a given material and geometry to be perceived as softer and/or more deformable than a gap length of 0-1 mm, for example. Additionally or alternatively, a gap length of 5 mm may allow an applicator 210 of given material and geometry to be perceived as easier to control when deformed and/or during deformation than a gap length of 9-10 mm, for example.

As the applicator 210 is deformed along the deformation path, the gap may be at least partially filled. For example, the length of the gap "G" may be reduced, such that its length is less, as measured along the deformation path, when the applicator 210 is in the second state than in the first state. As a non-limiting example, the change in the length of the gap "G" may allow for a pumping phenomenon, for example by forcing fluids (such as ink or air, for example), which may accumulate in the gap "G", into the material of the applicator 210. Additionally or alternatively, the change in the length of the gap "G" may allow the contact area between the applicator 210 and the transporter 220 to be increased.

Additionally or alternatively, as seen in FIG. 3, for example, the gap may even be absent when the applicator 210 is in the second state. Thus the axial portions of the intake face 212 of the applicator 210 and the discharge face 224 of the transporter 210 may come into contact with one another. These axial portions of the intake face 212 of the applicator 210 and the discharge face 224 of the transporter 220 may be at least partially arranged obliquely or perpendicularly to the deformation path. This contact may help to stabilize the applicator 210 with respect to the transporter 220, and/or may help to compress the applicator 210 between the transporter 220 between the axial portion of the discharge face 224 of the transporter 220 and the surface 99.

When the applicator 210 is in its second state, it may be in contact with the transporter 220 over a second contact area C2, which is larger than the first contact area C1. This increased contact area may allow the marker nib 200 to provide a higher flow rate of ink from the transporter 220 to the applicator 210 in the second state than in the first state. For example, the combined contact area between the corresponding peripheral and axial portions of the intake face 212 of the applicator 210 and the discharge face 224 of the transporter 220 in the second state may be greater than the contact area between the corresponding peripheral portions of the intake face 212 of the applicator 210 and the discharge face 224 of the transporter 220 in the first state.

Although the described embodiments were provided as different exemplary embodiments, it is envisioned that these embodiments are combinable or, when not conflicting, the features recited in the described embodiments may be interchangeable. Moreover, the features recited in the described embodiments are not inextricably linked to one another, unless such a linkage is clearly indicated between two given features.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

Although the present disclosure herein has been described with reference to particular embodiments, it is to be understood that these embodiments are merely illustrative of the principles and applications of the present disclosure.

It is intended that the specification and examples be considered as exemplary only, with a true scope of the disclosure being indicated by the following claims.

The invention claimed is:

1. A marker nib for applying ink to a surface, comprising an applicator having a writing tip configured to contact the surface to apply ink thereto, and a transporter configured to transport ink received from a reservoir to the applicator, the applicator being configured to increase its ink flow rate at the writing tip when pressure is applied thereto, thereby allowing to vary marking intensity by modulating the pressure applied to the surface by the applicator, wherein the applicator is reversibly deformable in compression from a first state to a second state, the applicator presenting a first flow rate in the first state and a second flow rate in the second state, and wherein the applicator is configured to remain in the first state in contact with the transporter over a first contact area when a pressure applied to the applicator by the surface is less than or equal to a first value, and to enter the second state when the pressure applied to the applicator by the surface is greater than or equal to a second value greater than the first value;

wherein the marker nib extends along an axial direction, and wherein the first contact area has a length of 3 mm or more as measured along the axial direction in the first state.

2. The marker nib according to claim 1, wherein the applicator is configured to remain in the first state when the pressure applied to the applicator by the surface is less than or equal to the first value, the first value corresponding to a force of approximately 100 mN applied normal to the surface and/or applied along a longitudinal direction of the marker nib.

3. The marker nib according to claim 1, wherein the applicator is configured to enter the second state when the pressure applied to the applicator by the surface is greater than or equal to the second value greater than the first value, the second value corresponding to a force of approximately 300 mN applied normal to the surface and/or applied along a longitudinal direction of the marker nib.

4. The marker nib according to claim 1, the applicator comprising a first material and the transporter comprising a second material, and wherein the first material has a higher capillarity than the second material.

5. The marker nib according to claim 1, the applicator comprising a first material and the transporter comprising a second material, and wherein the first material is softer than the second material.

6. The marker nib according to claim 1, the applicator comprising a first material and the transporter comprising a second material, and wherein the first material comprises a foam and wherein the second material comprises one or more of natural felt, synthetic felt, and/or sintered plastic.

7. The marker nib according to claim 1, wherein the marker nib extends along an axial direction and comprises an applicator mount to which the applicator is mounted, the applicator mount comprising a peripheral wall, which authorizes and limits a deformation of the applicator when pressure is applied thereto.

8. The marker nib according to claim 1, wherein the marker nib extends along an axial direction and comprises a gap arranged between the transporter and the applicator along the axial direction.

9. The marker nib according to claim 8, wherein the gap has a length of 5 mm or less, as measured along the axial direction, when no pressure is applied to the writing tip.

10. The marker nib according to claim 8, wherein the gap is filled at least in part when a pressure is applied onto the applicator.

11. A marker comprising the marker nib according to claim 1 and an ink reservoir connected to the transporter.

12. The marker according to claim 11, comprising an applicator mount, to which the applicator and the transporter is mounted, and connectable to the reservoir.

13. The marker according to claim 11, wherein the reservoir comprises a free ink tank and/or an ink storage medium.

14. A marker nib for applying ink to a surface comprising:

an applicator having a writing tip configured to contact the surface to apply ink thereto, and a transporter configured to transport ink received from a reservoir to the applicator;

wherein the applicator is reversibly deformable in compression from a first state to a second state, the applicator presenting a first flow rate in the first state and a second flow rate in the second state;

wherein the applicator is configured to remain in the first state when a pressure applied to the applicator by the surface is less than or equal to a first value, and to enter the second state when the pressure applied to the applicator by the surface is greater than or equal to a second value greater than the first value; and wherein the marker nib extends along an axial direction, and wherein the applicator contacts the transporter over a first contact area in the first state, the first contact area has a length of 3 mm or more as measured along the axial direction in the first state.

15. The marker nib of claim 14, further comprising a transporter configured to transport ink received from a reservoir to the applicator.

16. The marker nib of claim 14, wherein the applicator is configured to increase ink flow rate at the writing tip when pressure is applied thereto, thereby allowing to vary marking intensity by modulating the pressure applied to the surface by the applicator.

17. The marker nib according to claim 14, wherein the applicator is configured to remain in the first state when the pressure applied to the applicator by the surface is less than or equal to the first value, the first value corresponding to a force of approximately 100 mN applied normal to the surface and/or applied along a longitudinal direction of the marker nib.

18. A marker comprising the marker nib according to claim 15 and an ink reservoir connected to the transporter.

19. A marker nib for applying ink to a surface, comprising an applicator having a writing tip configured to contact the surface to apply ink thereto, and a transporter configured to transport ink received from a reservoir to the applicator, the applicator being configured to increase its ink flow rate at the writing tip when pressure is applied thereto, thereby allowing to vary marking intensity by modulating the pressure applied to the surface by the applicator, wherein the applicator is reversibly deformable in compression from a first state to a second state, the applicator presenting a first flow rate in the first state and a second flow rate in the second state, and wherein the applicator is configured to remain in the first state when a pressure applied to the applicator by the surface is less than or equal to a first value, and to enter the second state when the pressure applied to the applicator by the surface is greater than or equal to a second value greater than the first value;

wherein the applicator is in contact with the transporter over a first contact area in the first state, the applicator is in contact with the transporter over a second contact area in the second state, and the second contact area is greater than the first contact area;

wherein the marker nib extends along an axial direction, and wherein the first contact area has a length of 3 mm or more as measured along the axial direction in the first state.

* * * * *